United States Patent [19]

Kachik et al.

[11] 3,956,010

[45] May 11, 1976

[54] DRY PICKLING METHOD

[75] Inventors: Robert H. Kachik, Washington Township, Westmoreland County; Arthur J. Pignocco, Franklin Township, Westmoreland County, both of Pa.

[73] Assignee: United States Steel Corporation, Pittsburgh, Pa.

[22] Filed: Oct. 1, 1974

[21] Appl. No.: 510,975

Related U.S. Application Data

[63] Continuation-in-part of Ser. No. 367,922, June 7, 1973, abandoned.

[52] U.S. Cl. ..... 134/2; 134/30; 134/37

[51] Int. Cl.[2] ..... C23G 5/00; B08B 5/00

[58] Field of Search ..... 134/2, 19, 30, 34, 37; 75/34

[56] References Cited

UNITED STATES PATENTS

| | | | |
|---|---|---|---|
| 2,199,418 | 5/1940 | Redmond et al. | 134/3 X |
| 2,288,980 | 7/1942 | Turin | 134/2 UX |
| 2,437,528 | 3/1948 | Hodil | 134/30 X |
| 2,619,434 | 11/1952 | Kraus et al. | 134/2 |
| 2,625,495 | 1/1953 | Cone et al. | 134/2 |

*Primary Examiner*—S. Leon Bashore
*Assistant Examiner*—Marc L. Caroff
*Attorney, Agent, or Firm*—William L. Krayer

[57] ABSTRACT

Hot rolled steel is pickled with chlorine gas at temperatures between about 1250°to 2500°F.

7 Claims, No Drawings

DRY PICKLING METHOD

This application is a continuation-in-part of our copending application Ser. No. 367,922, filed June 7, 1973, now abandoned.

BACKGROUND OF THE INVENTION

This invention relates in general to pickling and more particularly to a method of dry pickling. Pickling is the process of chemically removing oxides and scale from the surface of a metal, conventionally by the action of water solutions of inorganic acids. While acid pickling is only one of several methods of removing undesirable surface oxides, it is the most widely used in the manufacture of sheet and tin mill products, because of comparatively low operating costs and ease of operation. Considerable variation in type of pickling solution, operation, and equipment is found in the industry. Among the types of pickling equipment may be mentioned batch picklers, modified batch, semi-continuous and continuous picklers.

With the advent of continuous cold reduction mills, it was necessary to design and develop suitable equipment to remove the oxides resulting from the continuous hot-rolling operation and prepare the hot rolled breakdowns for cold reduction in coil form. This operation is performed in a continuous pickling line. The primary function of a continuous pickling line, as of other pickling processes, is the removal of oxide from the steel surface. This serves to promote maximum reduction with a minimum of power, to assure good roll life in the cold reduction mills and to secure the increased surface density possible with cold working. Modern continuous pickling lines operate at speeds as high as 700 to 800 ft. per min.

Prior to our invention, the pickling zone consisted of several individual acid-proof tanks located in a series, comprised of an effective immersion length of about 250 to 300 ft. While most lines have from three to five tanks, each about 70 to 80 ft. long, some modern lines have only one long tank, divided by weirs into four or five sections, thereby increasing effective immersion depth about 10 to 15 percent. The inside dimensions of these tanks have been more or less standardized at 4 ft. in depth and about 1 ft. wider than the maximum product width. A steel sheel is used for support with layers of rubber bonded to the steel and the rubber is protected from abrasion by a lining of about 9 in. of silica-base acid-proof brick. For operating temperatures in excess of 200°F, a bakelite-base cement generally is used for bonding. In modern high-speed lines operating at 200° to 220°F, the brick facing gradually is eroded away, so that replacement is required after several years of operation. Occasionally, small leaks in the rubber lining and the steel tank require patching.

Underpickling results when the steel has not had sufficient time in the pickling tanks to become free of adherent scale and occurs when acid concentration, solution temperatures and line speed are not balanced properly. Variations in the oxide and composition of the steel are also factors in underpickled product, as well as such factors as coiling temperature off the hot strip mill and inadequate amount of cold working through the processor. Overpickling results from line delays which permit sections of the steel to remain in the acid too long. The presence of an inhibitor reduces iron loss, but when an inhibitor is not used, iron loss during a short delay period appreciably reduces thickness of the steel and raises the hazard of hydrogen embrittlement. Pitting is related to overpickling, the presence of non-metallic inclusions near the steel surface, and to rolled-in scale, slag or a refractory substance. While overpickling is not common in continuous pickling operations, its occurrence does have a very serious effect on cold reduction performance and surface appearance of the finished product. Product damage from handling or improper equipment adjustment can render the steel unsuitable for further processing.

Conventional pickling processes employing acids generally create extremely difficult waste disposal problems. Spent pickle liquors are highly destructive and undesirable. At present, one of the more economical and environmentally acceptable disposal methods is to dump the waste pickle liquor into deep wells; in some cases, however, the application of considerable pressure is necessary to see that the fluid is dispersed into the underground strata. But little is known about the ultimate disposition and effects of deep-well waste disposal, and it is generally thought that such methods of disposal should be discontinued if a suitable alternative is found.

U.S. Pat. No. 2,619,434 to Kraus teaches that mixtures of carbon monoxide and chlorine may be used to remove oxide scales from certain metals. In particular, Kraus uses mixtures of chlorine and carbon monoxide to remove scale from reaction zones deposited during a vapor phase reaction, particularly of a titanium halide with an oxidizing gas. In example 3, Kraus compares his chlorine/carbon monoxide mixture with the use of chlorine alone, finding his mixture far superior. This scale, which is formed in a vapor phase oxidation of chlorides and not formed from a substrate, is quite different from the type of scale which is subject to migration of ions such as iron ions through the substrate to the scale, which are capable of changing the valence state of the iron.

Cone et al, in U.S. Pat. No. 2,625,495, also uses a combination of two gases to treat the scale. The first gas used by Cone is always an oxidizing gas and chlorine may be used as the second gas. In ths procedure Cone appears to require a thin oxide layer and one which contains carbonaceous material, rather than a thick scale layer of the type one obtains from hot rolled material. Cone does not obtain enough carbon from the carbonaceous material to reduce a thick scale, i.e., generally more than 1/10,000 inch thick, such as those obtained from hot strip.

Upon carefully examining the patents of Kraus and Cone, we find that both refer to the use of chlorine gas (or Helgas) but impose the additional condition that carbon monoxide or a carbon monoxide precursor (such as carbon or rolling oils on the strip) or other reducing agent such as hydrogen must also be present to effect the removal of the particular oxides treated. This reaction, the chlorination of oxides in a reducing atmosphere, is a very rapid and thermodynamically favorable one going essentially to completion according to the following equation as applied to $Fe_2O_3$ at 1250°F (675°C or 950°K):

The pickling processes which require BOTH carbon monoxide and chlorine for carbon steels:

$$Fe_2O_3 + 3CO + 2Cl_2 \rightarrow 2FeCl_2 + 3CO_2$$

$$\Delta F^\circ_{950^\circ K} = 3(-94{,}595) + 2(-53{,}000) - [3(-46880)+(-136{,}800)]$$

$$\Delta F^\circ_{950^\circ K} = -112{,}345 \text{ Cal/mole} = -RT \ln K$$

Where K is the equilibrium constant at 950°K $$\ln K = \frac{112{,}345}{(2)(950)} = 59.1$$

$$\text{or } K \sim 10^{26} = \frac{(^aFeCl_2)^2 (^aCO_2)^3}{(^aFe_2O_3)(^aCO)^3 (^aCl_2)^2}$$

where $a$'s are the activities (concentrations) of the components used in this reaction. The equilibrium is decidedly in favor of the reaction, as written, and the reaction should go to completion to form $FeCl_2$ and $CO_2$.

For the process as practiced on stainless steels the following equation applies:

$$Cr_2O_3 + 3CO + 2Cl_2 \rightarrow 2CrCl_2 + 3CO_2$$

$$\Delta F^\circ_{950^\circ K} = 3(-94595) + 2(-68{,}000) - [3)-46880)+(-212{,}200)]$$

$$\Delta F^\circ_{950^\circ K} = -66{,}945 \text{ Cal/mole} = -RT\ln K$$

$$\ln K = \frac{66945}{(2)(950)} = 35.2$$

$$\text{or } \log K = 15.3$$

$$K \sim 10^{15} = \frac{(^aCrCl_2)^2 (^aCO_2)^3}{(^aCr_2O_3)(^aCO)^3 (^aCl_2)^2}$$

Again the reaction is in favor of the reaction as written and should go to completion to form $CrCl_2$ and $CO_2$. These are the chemical reactions which form the basis of the patents of Cone, Turin and Kraus.

The reader may also be interested in the pickling methods discussed by Kuhn in U.S. Pat. No. 3,544,368, Bartek in U.S. Pat. No. 3,467,549 and Singer in U.S. Pat. No. 3,529,998.

SUMMARY OF THE INVENTION

As can be noted from the above thermodynamic calculations both gases (carbon monoxide and chlorine) are needed in the pickling gas atmosphpere when the oxide scale is to be reacted off the steel. The gases (carbon monoxide and chlorine) do not perform independent functions i.e. one to clean or remove carbonaceous material from the strip and the other to pickle the strip in the absence of carbonaceous material but instead both are needed in the reaction to effect the removal of oxide scale by chemical attack of the scale. Kraus shows that chlorine alone is much less effective at the temperature of 700°C by a factor of more than 31. (3.1 parts by weight of scale removed/min ft$^2$ for CO-$CL_2$ to less than 0.1 part by weight/min ft$^2$ for chlorine alone). Kraus makes this comparison to demonstrate that the reaction with chlorine is quite slow at 700°C. That this reaction occurs at all can probably be explained by the removal (by evaporation) of one of the reaction products (vapor pressure of $FeCl_2$ at 700°C is about 10 mm Hg). This reaction would not occur at 700°C with stainless steels because $CrCl_2$ boils above 1300°C. Kraus did not observe the very rapid descaling or pickling we report in our findings because the oxide he was removing was in fact deposited by the vapor phase oxidation of chlorides and was not formed by an oxidation of the metal substrate. The cracking of the scale and subsequent undercutting of the scale which we believe is responsible for our results did not occur in the deposits described in Kraus' patent.

We have invented a method of pickling steel which is very rapid; it eliminates the problem of disposing of waste pickle liquor, decreases capital costs by eliminating the need for a series of pickling tanks and associated equipment, reduces maintenance costs, obviates the need for the addition of various chemicals to inhibit the consumption of iron during the pickling process, provides better control over the degree of pickling treatment, and renders recycling of the active pickling agent more practical than in previous processes.

Our invention contemplates the pickling of steel with chlorine gas. In particular, it includes the pickling of hot steel emerging from a hot strip process at a temperature of at least about 1250°F by striking the hot strip steel, which may be carbon or stainless steel, with jets of chlorine gas and subsequently scraping or flexing the scale. Temperatures as high as 2500°F or higher can be used, but with full chlorine availability there may be a tendency at such high temperatures to cause pitting. No carbon monoxide, graphitic carbon, hydrogen or other reductant is necessary in our process.

For our pickling processes requiring only $Cl_2$, the following equilibria apply:

$$Fe_2O_3 + 2Cl_2 \rightarrow 2FeCl_2 + 3/2\ O_2$$

$$\Delta F^\circ_{950^\circ K} = 2)-53{,}000) - (-136{,}800) = +30{,}800 \text{ Cal/mole}$$

$$\text{or } \ln K = -\frac{30{,}800}{(2)(950)} = -16.2$$

$$\text{or } K \sim 10^{-7} = \frac{(^aFeCl_2)^2 (^aO_2)^{3/2}}{(^aFe_2O_3)(^aCl_2)^2}$$

The case for stainless steel is:

$$Cr_2O_3 + 2Cl_2 \rightarrow 2CrCl_2 + 3/2\ O_2$$

$$\Delta F^\circ_{950^\circ K} = 2(-68{,}000) - (-212{,}200) = +76{,}200 \text{ Cal/mole}$$

$$\text{or } \ln K - \frac{-76{,}200}{(2)(950)} = -40.1$$

$$\text{or } K \sim 10^{-17} \frac{(^aACl_2)^2 (^aO_2)^{3/2}}{(^aFe_2O_3)(Cl_2)^2}$$

These equilibria are decidedly in favor of the reverse reaction i.e. $2FeCl_2 + 3/2\ O_2 \rightarrow Fe_2O_3 + 2Cl_2$. This reverse reaction is in fact the one that is used in the vapor phase oxidation of chlorides as described by Kraus and which serves to deposit the metal oxide onto the walls of his reaction chamber.

Cone, Turin and Kraus all use the combination of chlorine and carbon (Reaction Process No. 1) and none use chlorine alone to react with oxides. Cone emphasizes the need for both gases. Although the use of both carbon monoxide and chlorine is not stated affirmatively in the Turin patent, it does cite the need for " . . . the products of combustion of a hydrocarbon fuel burned with a substantial amount of chlorine and with substantially less air than would normally be required to support complete combustion of the fuel if burned with air alone" i.e. it cites the need for the combination of chlorine and carbon monoxide formed by the incomplete combustion of fuel for satisfactory pickling. Turin therefore also employs a mixture of carbon monoxide and chlorine although he does not specifically refer to carbon monoxide in his claims.

EXAMPLE I

Dry Pickling of a Small Piece of 316 Stainless Steel Strip

A sample of hot rolled, scaled, 316 Stainless Steel Strip. ¾ inch × ¾ inch × ¼ inch thick, was fitted with a thermocouple and placed into a 1¼ inches diameter × 20 inches long quartz reactor tube. The large area of the stainless steel panel was placed in the tube approximately normal to and 4 inches from a gas jet. The entire assembly was then placed into a tube furnace and heated. When the sample reached 1600°F, chlorine was passed through the jet and allowed to impinge upon the sample surface at a rate of 55 CC/min. for a period of 2 minutes. The sample was then moved to the cold end of the tube and allowed to cool below 300°F at which time the sample was removed and inspected. The sampel was covered with a layer of green-black material. After rinsing and lightly scrubbing the sample in water, the surface was judged to be pickled and clean.

EXAMPLE II

Dry Pickling of a Small Piece of Scaled Carbon Steel Strip

A sample of heavily oxidized carbon steel sheet, ¾ inch × ¾ inch × ¾ inch thick was fitted with a thermocouple and placed into a reactor tube such that the large face of the panel was normal to and approximately 2 inches from a gas jet. The assembly was placed in a tube furnace and heated to 1320°F at which time chlorine gas was passed through the jet at a rate of 55 CC/min. for 2 minutes. The sample was then moved to the cold end of the tube. When the sample temperature dropped below 300°F, it was removed from the tube and examined. The material on the surface of the specimen had a wrinkled appearance. Upon lightly rubbing the specimen in water, this material was readily removed and the sample was judged clean.

EXAMPLE III

Continuous Dry Pickling of Heavily Oxidized Carbon Steel Strip

A coil of oxidized carbon steel strip, 6 inches wide, was passed through an induction heater, heated in air to above 1500°F and then passed into the dry pickling chamber at a rate of 20 ft./min. This chamber contained a manifold to which were attached 11 gas jets used for distributing chlorine gas uniformly across the strip surface. The chlorine was admitted to the strip at a rate of 0.8 ft.$^3$/min. As the strip exited from the chamber, it was allowed to cool and then gently rubbed with a wet cloth. Because the jet assembly did not adequately distribute sufficient amounts of chlorine across the strip, a satisfactorily pickled complete strip was not obtained. However, the area of the strip which was adequately exposed to chlorine issuing from the jets was pickled and satisfactorily cleaned by this procedure.

The effects of various operating parameters for our dry pickling procedure are shown in the following tables:

TABLE I

Experiments designed to demonstrate that $Cl_2$ alone can be used to pickle stainless steel samples. (Gas flowing continuously as temperature is raised).

| Sample | $Cl_2$ (CC/Min. Air STP) | CO (CC/Min. Air STP) | Max. Temp. | Observation |
|---|---|---|---|---|
| 1"×1"×1/16" 304 S Steel | 43 | 43 | 1000°F | Very little reaction observed. |
| 3/8"×3/8"×1/16" 304 S Steel | 43 | 43 | 1200°F | Rapid increase in temperature (Strong exotherm) with evolution of chlorides. Sample does not clean up completely with scrubbing in water. |
| 3/8"×3/8"×1/16" 304 S Steel | 43 | 43 | 1260°F | Rapid increase in temperature (Strong exotherm) with evolution of chlorides. Sample cleans up with scrubbing in water. |
| 3/4"×3/4"×1/16" 316 S Steel | 43 | None | 1250°F | Rapid increase in temperature (Strong exotherm) with evolution of chlorides. Sample cleans with scrubbing in water. |
| 3/4"×3/4"×1/16" 316 S Steel | 43 | None | 1200 – 1335°F | Very little reaction at 1200°F. Rapid increase in temperature (Strong exotherm) at 1335°F. |

-continued

| Sample | $Cl_2$ (CC/Min. Air STP) | CO (CC/Min. Air STP) | Max. Temp. | Observation |
|---|---|---|---|---|
| | | | | Sample cleans with scrubbing in water. Sample heavily etched. |

Table II

Chlorine Exposure Data for Cleaning of Stainless Steel

| Sample | $Cl_2$ (CC/Min.STP) | Temp. | Time | Observation |
|---|---|---|---|---|
| 3/4"×3/4"×1/4" 316 S Steel | 3 | 1300°F | 2 Min. | Some indication of reaction but no exotherm - scrubbing in water has little effect. Sample not clean. |
| 3/4"×3/4"×1/4" 316 S Steel | 21 | 1300°F | 1 Min. | As above. |
| 3/4"×3/4"×1/4" 316 S Steel | 21 | 1600°F | 1 Min. | As above. |
| 3/4"×3/4"×1/4" 316 S Steel | 21 | 1300°F | 2 Min. | Sample lightly coated with chlorides. Scrubbing in water produced clean areas on sample. |
| 3/4"×3/4"×1/4" 316 S Steel | 21 | 1600°F | 2 Min. | Sample lightly coated with chlorides. Scrubbing in water produced clean sample. |

Table III

Experiments designed to demonstrate that $Cl_2$ alone can be used to pickle Carbon Steel samples

| Sample | $Cl_2$ (CC/Min.STP) | Temp. | Time | Observaton |
|---|---|---|---|---|
| 3/4"×3/4"×1/4" Carbon Steel | 12 | Room temp. | 2 Min. | No reacton observed. |
| 3/4"×3/4"×1/4" Carbon Steel | 21 | 620°F | 2 Min. | No reacton observed. |
| 3/4"×3/4"×1/4" Carbon Steel | 21 | 1030°F | 2 Min. | Approximately 40% of sample appears attacked by chlorine. Undercutting is observed. |
| 3/4"×3/4"×1/4" Carbon Steel | 21 | 1320°F | 2 Min. | Surface seems to be attacked. After a water was, sample appears clean. |

These data indicate that the optimum specimen temperature for dry pickling is about 1600°F. Between 1250°F and 1600°F, the cleaning action was somewhat sluggish, while in the range 1600°F to 1800°F there was a tendency to produce pickled surfaces that were stained and/or pitted. We prefer to use a range of 1400°F to 1700°F.

The optimum post treatment of pickled samples appeared to be an immediate water spray quench. Most of the surface contaminants either spalled off during the quench, or could be readily removed by light brushing. These results suggest that the mechanical action of spray quenching of annealed and $Cl_2$ pickled stainless steel produces a clean surface without the necessity of additional mechanical abrasion. Spraying the treated strip with water immediately after it had exited the treatment chamber facilitated removal of the surface contaminants. That is, a water-sprayed area could be rubbed completely clean more readily than an adjacent area that had not been sprayed.

We have found that at least 12 cc $Cl_2$ were required to clean 1 sq. in. of surface area but that the amount of chlorine required is independent of scale thickness — that is, the same amount of chlorine may suffice for a thick scale as for a thin one. Our invention is effective on scales as thin as one ten-thousandth of an inch or thinner and thicknesses as high as are ever encountered. The chlorine may be diluted with an inert gas.

The $Cl_2$ analysis experiments also established that about 90 percent of the flowing $Cl_2$ reacted with the specimen surface and suggested that an optimized pickling arrangement might approach 100 percent efficiency.

Our pickling procedure employs the reaction of chlorine gas with the surface of stainless or carbon steel strip to effect the easy removal of oxides, or scale from these surfaces. In preliminary tests, the reaction of these gases with small sections of hot steel strip (temperature of the strip in excess of 1250°F) was found to be quite satisfactory and it produced a thin adherent layer of chlorides (probably under metal scale) on the surface of the strip. This layer remained on the strip and protected the strip from further oxidation while at high temperature. Upon allowing the strip to cool to ambient temperature, this chloride layer and scale were readily removed from the strip by scrubbing the strip in water, thereby producing a clean bright pickled steel surface. Because the chlorination of oxides of iron and chromium using chlorine (or HCl) alone are not very favorable reactions, it would appear that the mechanism by which the pickling procedure functions does not entail the direct stoichiometric reaction of chlorine with the oxide or scale but instead involves a process by which the reactant gases pass through the scale (such as through cracks in the scale) to react with the underlying oxides or free metal causing the scale to loosen. Such reactions as:

$$Fe + Cl_2 \rightarrow FeCl_2$$

or $$FeO + Cl_2 \rightarrow FeCl_2 + \tfrac{1}{2} O_2$$

are much more thermodynamically favorable ones than the reaction with oxide scale and could be the basis for the success of this pickling procedure. In any event, this procedure was quite effective in removing both mill scale and laboratory produced heavy oxide layers from the surfaces of carbon steel and stainless steel strip. The advantages of such a pickling procedure are:

1. The procedure is simple, quite rapid, effective, and could be readily automated.
2. The capital investment for equipment should be significantly less than that found in conventional pickling procedures and should require little maintenance.
3. No inhibitors are required in this procedure for the reactants can be easily shut off, thus minimizing the possibility of damage to equipment or product.

4. If the chlorides and oxides scrubbed from the strip surface are placed in a kiln and spray roasted to decompose the chlorides while producing $Cl_2$ or HCl for recycling, the problem of waste pickle liquor disposal is not only eliminated, but the creation of undesirable solid wastes is minimized.

Thus, it may be seen that our invention is a method of pickling hot steel strip at a slab or strand temperature of from 1250°F to 2500°F or above, comprising striking the hot steel with a jet of chlorine gas and thereafter removing the loosened scale by mechanical action such as by a water jet, brush, or scraper. The chlorine may be diluted by 50% or even more by an inert gas, such as nitrogen or $Co_2$. The flow of the chlorine should provide at least 12 cc per square inch of strip surface. The contact time required is very low, or negligible, i.e., as low as ½ second to be practically effective. The removal of the scale loosened by the undercutting action of the chlorine is completed by the forceful impact of water sprays or jets. A conventional quenching spray useful for stainless is satisfactory to remove loosened scale treated by our process.

Our invention is not limited to the above specific illustrations and examples. It may be otherwise variously practiced within the scope of the following claims.

We claim:

1. Method of pickling hot steel having an external layer of metal oxide scale comprising contacting the hot steel with chlorine gas in the substantial absence of a reducing agent, said chlorine gas being impinged against the steel surface at a rate of at least 12cc. per square inch of steel surface, to loosen scale thereon and then removing the loosened scale by mechanical action.

2. Method of claim 1 in which the scale is at least one ten-thousandth of an inch thick.

3. Method of claim 1 in which the scale is removed by the force of a water jet.

4. Method of claim 1 in which the chlorine is diluted with an inert gas.

5. Method of claim 1 in which the hot strip steel is at a temperature of at least 1250°F.

6. Method of claim 1 in which the steel is cooled prior to removing the scale by mechanical action.

7. Method of claim 1 in which the hot strip steel is at a temperature of 1400°F to 1700°F.

* * * * *